United States Patent [19]

Kurosawa et al.

[11] Patent Number: 5,044,803

[45] Date of Patent: Sep. 3, 1991

[54] APPLICATOR TOOL FOR LIQUIDS

[75] Inventors: Yoshitaka Kurosawa, Hachioji; Minoru Imamura; Makoto Iwamura, both of Yokohama, all of Japan

[73] Assignee: Three Bond Co., Ltd., Tokyo, Japan

[21] Appl. No.: 551,049

[22] Filed: Jul. 9, 1990

Related U.S. Application Data

[63] Continuation of Ser. No. 264,452, Oct. 28, 1988, abandoned, which is a continuation-in-part of Ser. No. 904,169, Sep. 5, 1986, abandoned.

[30] Foreign Application Priority Data

Sep. 11, 1985 [JP] Japan ..... 63-199322

[51] Int. Cl.[5] ..... B05C 17/00

[52] U.S. Cl. ..... 401/9; 401/139; 401/193; 401/261; 401/262; 401/265; 222/570

[58] Field of Search ..... 401/9, 10, 11, 193, 401/261, 262, 265, 139; 222/570, 526

[56] References Cited

U.S. PATENT DOCUMENTS

| | | | |
|---|---|---|---|
| 807,887 | 12/1905 | Walker | 401/265 X |
| 1,208,865 | 12/1916 | Warwick | 401/11 |
| 1,980,552 | 11/1934 | Ryan | 401/9 |
| 2,065,298 | 12/1936 | Abbott | 401/193 X |
| 3,411,178 | 11/1968 | Szentivanszky et al. | 18/3.5 |
| 3,589,820 | 6/1971 | Ward | 401/193 X |
| 3,797,946 | 3/1974 | Witzmann et al. | 401/262 X |
| 3,804,539 | 4/1974 | Sussman et al. | 401/265 |
| 3,830,573 | 8/1974 | Schwartzman | 401/193 |
| 4,080,078 | 3/1978 | Halm | 401/262 X |
| 4,484,976 | 11/1984 | Despins | 156/578 |

FOREIGN PATENT DOCUMENTS

| | | | |
|---|---|---|---|
| 662452 | 7/1938 | Fed. Rep. of Germany | 401/193 |
| 1153497 | 8/1963 | Fed. Rep. of Germany | 401/139 |
| 165195 | 10/1958 | Sweden | 401/262 |

*Primary Examiner*—Steven A. Bratlie
*Attorney, Agent, or Firm*—Henry C. Nields

[57] ABSTRACT

A tool for applying liquids has a nozzle portion which is provided with a spatulate section having a discharge orifice in the side thereof from which the liquid emerges. The spatulate section is mounted on a tool body which is freely rotatable, so that the liquid may be applied to the surface of a tubular object in a convenient manner.

10 Claims, 5 Drawing Sheets

FIG.9
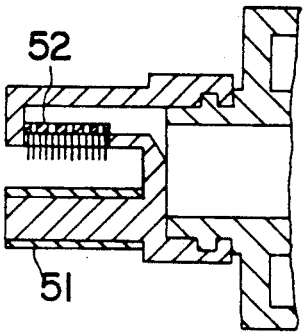
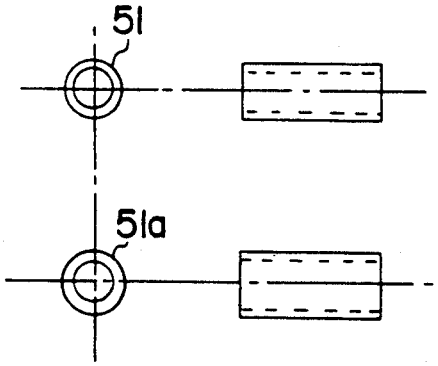
FIG.9a
FIG.9b
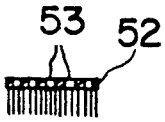
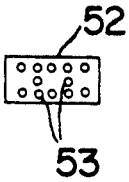
FIG.9c

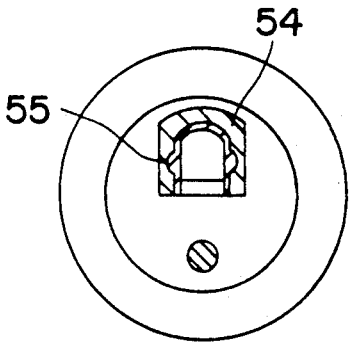
FIG.10a
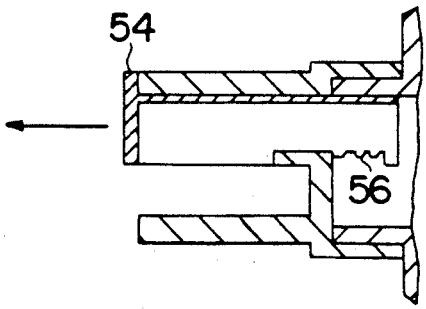
FIG.10
FIG.10b
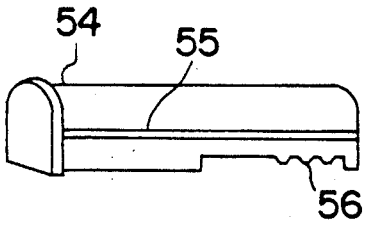

APPLICATOR TOOL FOR LIQUIDS

This application is a continuation of application Ser. No. 264,452, filed Oct. 28, 1988, which is a continuation-in-part of application Ser. No. 904,169, filed Sept. 5, 1986 both abandoned.

BACKGROUND OF THE INVENTION

1. Field of the Invention

The present invention relates to a tool for applying a liquid.

2. Description of the Present Art

It is known that there are various types of application tools for applying an adhesive, sealing agent etc. to, for example, a threaded surface on a continuous run of pipe, such as piping for a waterworks or a gas line, etc. For instance, there is a type of application tool in which an appropriate nozzle section is provided in the open section of a pipe filled with the adhesive or sealing agent. In another type of application tool, a toothbrush-shaped brush is provided at the nozzle section for smoothing the discharged liquids.

Then, in the case where the adhesive or the like is applied to the threaded surface of the pipe using the first type of application tool, the tube is held so that the nozzle orifice in the nozzle section is opposite the threaded surface, and, maintaining that state, the tube is rotated once while following the threaded surface. In addition, when performing this operation using the second type of applicator tool, the tube and pipe are held parallel while the brush contacts the threaded surface, and, maintaining this state, the brush follows along the threaded surface and is caused to make one circumference.

However, in this type of applicator tool, it is generally necessary to change one's grip on the tool to cause the nozzle orifice in the nozzle section or the brush to face the axial direction of the pipe, during the application, which results in an awkward operation. This is not only troublesome, but a long operating time is required and, in addition, lack of stability of the application position and the amount of the liquid applied are problems.

SUMMARY OF THE INVENTION

An object of the present invention is to provide, with due consideration to the drawbacks of such conventional devices, an application tool for liquids with which it is possible, when applying a liquid such as an adhesive or sealing agent and the like to a threaded surface on piping, such as for waterworks or gas line, to easily and quickly implement the action without changing one's grip on the tube or container holding the liquid.

In order to accomplish this objective of the present invention, a liquid applicator tool is provided comprising an application tool body which is freely rotatable with respect to a nozzle orifice from which a liquid is emitted, a spatulate section which projects from one side surface of the body of the application tool body, a discharge orifice which is formed in either the inside or the outside of the spatulate section, and a communication orifice which communicates between the nozzle orifice and the discharge orifice. When the liquid is being applied to a body for receiving the application, the body is caused to rotate relative to the nozzle orifice according to the change in direction in which the application surface is facing, so that the discharge orifice is always opposite the application surface.

BRIEF DESCRIPTION OF THE DRAWINGS

This and other objects, features, and advantages of the present invention will become more apparent from the following description of a preferred embodiment taken in conjunction with the accompanying drawings, in which:

FIG. 9 is a sectional explanatory drawing of the brush member and cylindrical member of the present invention.

FIG. 9*a* is a side view of cylindrical members of different thicknesses.

FIG. 9*b* and FIG. 9*c* are side and top views, respectively, of the brush member of the present invention.

FIG. 10 and FIG. 10*a* are a sectional explanatory view and a front explanatory view, respectively, of the expandable and contractable spatulate member of the present invention.

FIG. 10*b* is an oblique view of the expandable and contractable spatulate member of the present invention.

DESCRIPTION OF THE PREFERRED EMBODIMENT

A preferred embodiment of the present invention will now be explained with reference to FIG. 1, FIG. 2, FIG. 3 and FIG. 4.

Figure 1:
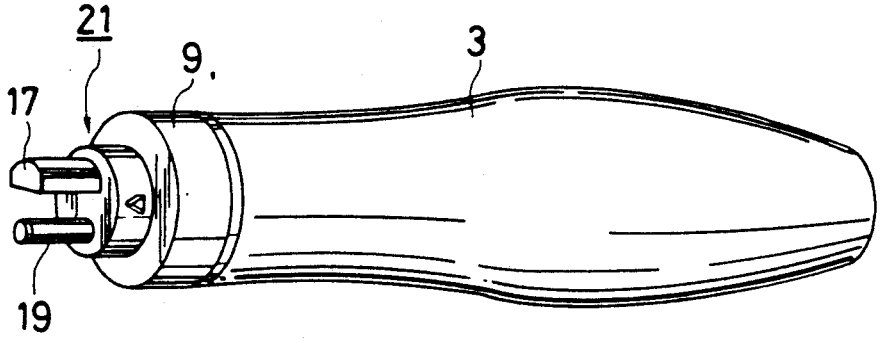
FIG. 1 is an oblique drawing of an adhesive tube provided in the embodiment of the present invention.
Figure 2:
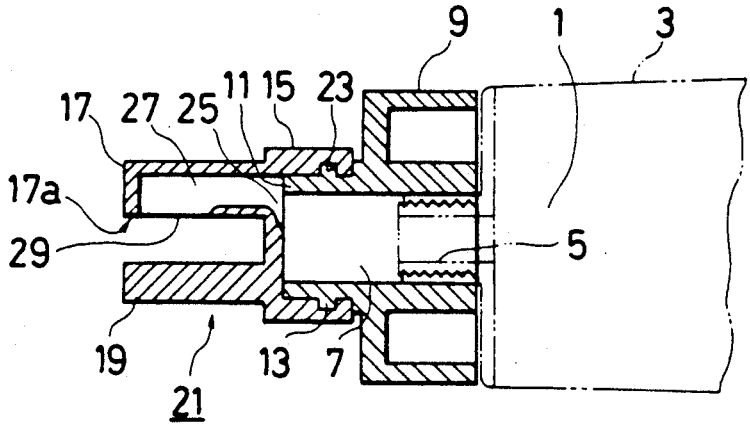
FIG. 2 and FIG. 3 are a sectional explanatory drawing and a front explanatory drawing respectively of the embodiment of the present invention.
Figure 3:
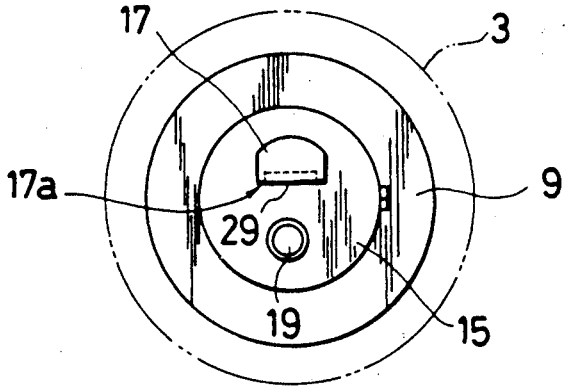

As shown in FIG. 1 to FIG. 3, a nozzle member 9 which forms a cylindrical nozzle 7 is screwed onto a plastic orifice section 5 of an adhesive tube 3 filled with an adhesive 1. Accordingly, the adhesive 1 expelled from the metal orifice section 5 is emitted from a nozzle tip section 11 to the front of the tube (to the left in FIG. 2) through the nozzle section 7.

This nozzle tip section 11 is formed in the shape of a cylinder and a projecting member 13 is formed on its external circumferential surface. An applicator tool 21 comprising an applicator tool body 15, a spatulate section 17, and a guide pin 19 is provided so that it can freely rotate on a prescribed rotational axis. Specifically, the applicator tool body 15 is formed in the shape of a cylinder with a diameter to engage the nozzle tip section 11. A circumferential channel 23 is formed on the inner circumferential surface of the applicator tool body 15. This circumferential channel 23 engages the projecting member 13. The applicator tool 21 is mounted so that it freely rotates around the center shaft of the nozzle 7.

In prescribed eccentric positions which are facing each other with the rotary shaft of the applicator tool body 15 between the spatulate section 17 and the guide pin 19 are provided, projecting in the forward direction of the adhesive tube 3.

A spatulate surface 17*a* is formed on the side surface of the spatulate section 17 which opposes the guide pin 19, for applying the adhesive 1 to the application surface. In addition, a receiving orifice 25, a communication orifice 27 and a discharge orifice 29 are formed in the base end, body sections and on the tip of the spatulate section 17 respectively.

The receiving orifice 25 is connected to the nozzle 7 of the nozzle member 9 and receives the adhesive 1 which flows from the nozzle 7. The communication orifice 27 carries the adhesive from receiving orifice 25 to the discharge orifice 29. The discharge orifice 29 discharges the transported adhesive 1 to the application surface.

Accordingly, passing through the receiving orifice 25 and the communication orifice 27, the adhesive 1 is caused to discharge from the prescribed tip position of the spatulate surface 17*a*.

In addition, in order that the guide pin 19 might more smoothly contact to an application receiving body, this guide pin 19 is formed in the shape of a cylindrical column. The space between the spatulate section 17 and the guide pin 19 can be adjusted by fitting a cylindrical member of a suitable thickness (for example, 0.5 mm, 1.0 mm, 1.5 mm, etc.), with an internal diameter equivalent to the external diameter of the guide pin 19, onto the guide pin 19. This is best shown in FIGS. 9 and 9*a*, wherein said cylindrical member is shown at 51. (A cylindrical member of different thickness is shown at 51*a* in FIG. 9*a*.)

In addition, in FIG. 1, the adhesive tube 3 is in the shape of a cylinder, but if it is formed in a shape of a handle of a gun, this adhesive tube can be more easily handled.

Figure 4:
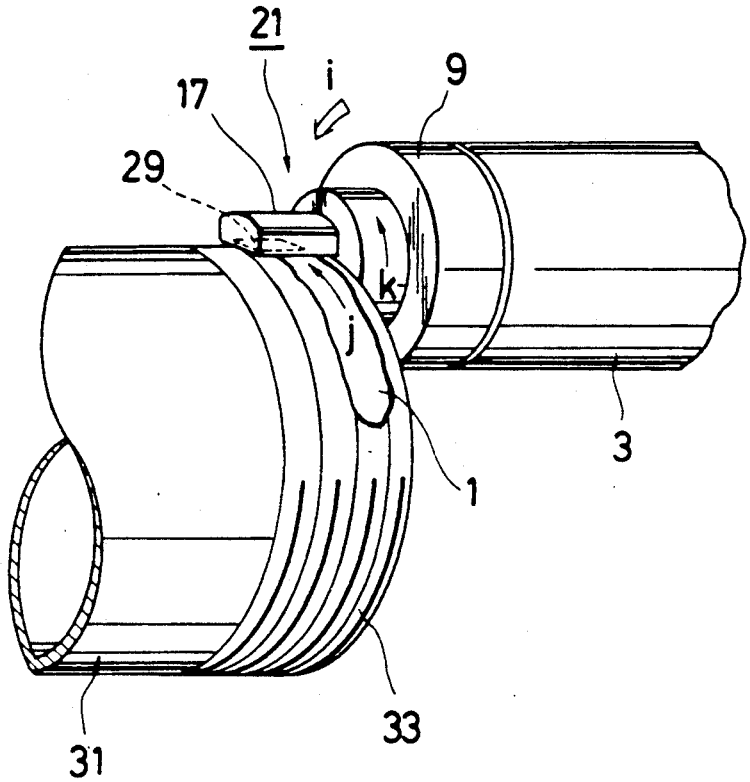
FIG. 4 is an operation explanatory drawing in the case where an adhesive is being applied to the outer circumferential surface of some piping using this adhesive tube.

Next, the use of the applicator tool will be explained, based on FIG. 4. FIG. 4 shows the operation, using the applicator tool when applying the adhesive onto the threaded surface of a pipe for waterworks and the like, which is made out of steel, plastic, and the like.

Specifically, in this case, first the spatulate section 17 of the applicator tool 21 is made to contact the threaded surface 33 of the pipe 31, and the tip of the pipe 31 is interposed between the spatulate section 17 and the guide pin 19 (not shown in FIG. 4). Then the adhesive tube 3 is suitably squeezed and the adhesive is forced out. The applicator tool is run along the threaded surface 33 of the pipe 31, being moved in the direction of the arrow i. When this is done, the adhesive 1 discharged from the discharge orifice 29 is smoothed out at the prescribed position on the threaded surface 33 by the spatulate section 17, and is applied in the direction of the arrow j.

In addition, since the tip of the pipe 31 is interposed between the spatulate section 17 and the guide pin 19, when the applicator tool is moved along the circumference of the pipe 31, the applicator tool 21 is caused to rotate in the direction of the arrow k. Accordingly, when the application action continues, the applicator tool makes one rotation following along the circumference of the pipe 31. And the discharge orifice 29 and the spatulate surface 17*a* are moved while opposed to the outer circumferential surface of the pipe 31. As a consequence, the adhesive 1 is discharged onto the prescribed position of the threaded surface 33, and the discharged adhesive 1 is applied and spread out on the threaded surface 33 by the spatulate surface 17*a*.

Accordingly, by means of the present invention, after the tip of the pipe 31 is interposed between the spatulate section 17 and the guide pin 19, simply moving the applicator tool 21 along the circumference of the pipe 31 causes the adhesive 1 to be applied to the pipe threaded surface 33, so that the application can be easily and quickly implemented.

In addition, during the application, the distance of the discharge orifice 29 from the tip of the pipe 31 is uniformly maintained, so that the application can be carried out at the prescribed application width at the prescribed application position. The amount of adhesive discharged can be easily regulated and the amount of application kept uniform.

Furthermore, with this embodiment of the present invention, by the contact of the spatulate section 17 and the guide pin 19 with the outer and inner circumferential surfaces respectively of the pipe 31, the applicator tool 21 is made to rotate, so that even if it is not consciously pressed against the spatulate surface 17*a*, it is made to contact the threaded surface 31 naturally. As a result, when the discharged adhesive 1 is applied on the threaded surface 31, the application is securely filled into the trough sections of the threads.

Further, in this embodiment of the present invention, the explanation was made in relation to the case where the adhesive 1 is applied to the outer circumferential surface of the pipe 31. However, in the case where the adhesive is applied to the inner circumferential surface of the pipe 31, the positions of the spatulate section 17 and the guide pin 19 may be reversed.

In addition, in order to made the application of the adhesive 1 and the like even more smoothly, it is possible to provide an irregular section on the spatulate surface which almost engages with the threads of the threaded surface, or to provide a brush of a suitable tooth brush shape. as shown at 52 in FIGS. 9, 9*b* and 9*c*. Said brush 52 may include holes 53.

Further, as illustrated in FIGS. 10, 10*a* and 10*b* by the adjusting member 54 having a protrusion 55 and a stopper 56, it is possible to let the spatulate section be capable of expansion and contraction, whereby the application position and application width can be changed, as one desired.

In addition, if it is possible to remove the applicator tool 21 from the nozzle member 9, and carry out the application action at the nozzle tip section 11 directly, the application action can be implemented either with the applicator tool 21 or nozzle member 9 as required.

In addition, the guide pin 19 is provided in this embodiment of the present invention to cause the applicator tool 21 to rotate, but this is not completely necessary. For example, it is acceptable to form the spatulate surface 17*a* of the spatulate section 17 as a curve with a suitable concave shape, and this concave surface can be moved in contact with the outer circumferential surface of the pipe 31. By doing this, the spatulate surface 17*a* will always rotate so that it is opposite the outer surface of the pipe as a result of the contact, so that the effect will be the same as for this embodiment of the present invention.

Furthermore, with the present embodiment, the receiving orifice 25 for the adhesive, the communication orifice 27, and the discharge orifice 29 are formed on the spatulate section 17. However, it is also acceptable to form the spatulate surface 17*a* on the spatulate section 17 but to separately provide for the liquid a conduit with a receiving orifice, a communication orifice, and a discharge orifice, and to position the discharge orifice adjacent to the spatulate surface.

Figure 5:
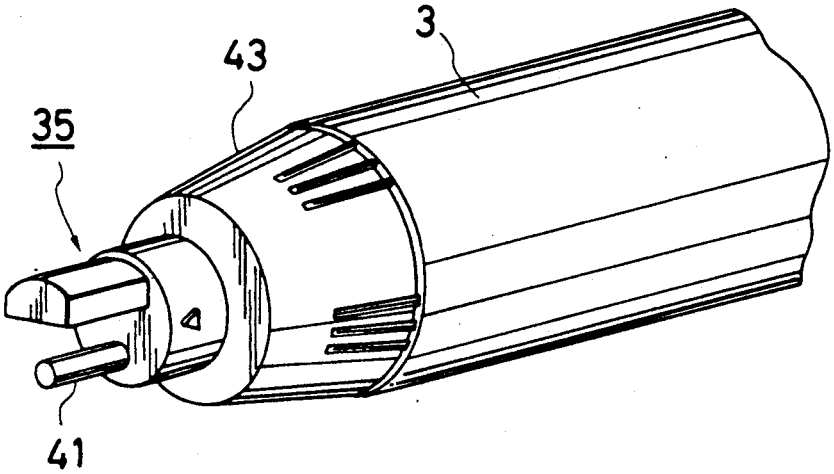
FIG. 5 and FIG. 6 are oblique and sectional explanatory drawings of another embodiment of the present invention.
Figure 6:
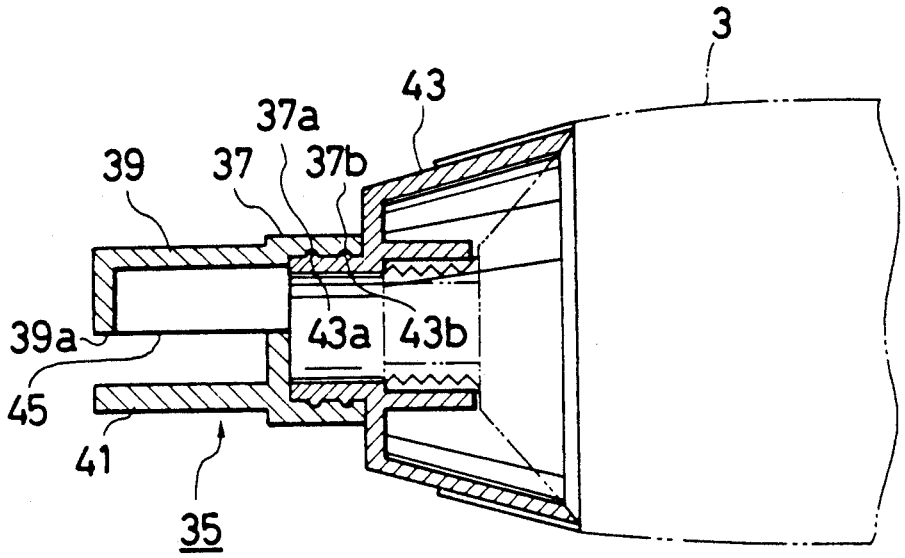

Now, FIG. 5 and FIG. 6 show the applicator tool for liquid 35 that is second embodiment of the present invention. As is seen in FIG. 1, 2 and 3, the applicator tool 35 comprises an applicator tool body 37, a spatulate section 39 and guide pin 41, and is put on a tip of the nozzle member 43 which is screwed onto a plastic orifice section of adhesive tube 3.

In the applicator tool 35 discharge orifice 45 is formed on the spatulate surface 39 along the longitudinal direction of the spatulate section from its base end to tip end. Therefore, by making use of the embodiment, the liquid emitted from a nozzle tip section 11 is applied more widely on the tip of the pipe compared with the embodiment shown in FIG. 1.

Moreover, in the applicator tool 35, there are provided two circumferential channels 37*a*, 37*b* on the inner circumferential surface of the applicator tool body 37 and two projecting members 43*a*, 43*b* on the external circumferential surface of the nozzle member 43. And the applicator tool body 37 is mounted on the nozzle member 43 by engaging two circumferential channels 37*a*, 37*b* to the two projecting members 43*a*, 43*b*. Therefore, in the applicator tool 35, the applicator tool body 37 is firmly connected to the nozzle member 43 and can rotate around the center shaft of the nozzle 43 more smoothly compared with that of the applicator tool 21.

Figure 7:
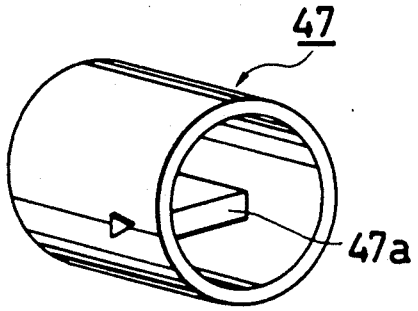
FIG. 7 and FIG. 8 are oblique and sectional drawings of a cap member for putting on the tips of the embodiments of the present invention.
Figure 8:
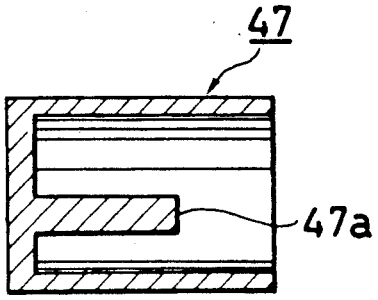

FIG. 7 and FIG. 8 show the cap member 47 to be fitted to the tip of the applicator tool 21, 35. As is seen, there is provided a protruding member 47*a* in the hole section of the cap member 47. Therefore, the discharge orifices 29, 45 are closed by the protruding member 47*a* when the cap member 47 is put on the tip of the applicator tool 21, 35.

With the liquid applicator tool of the present invention constructed in the above manner, in the case where liquids such as adhesives, sealing agents and the like are applied to the threaded surfaces on water or gas pipes, it is possible to carry out the application easily, quickly, and accurately without changing one's grip on the tube or container for the liquid.

What is claimed is:

1. A liquid applicator for applying liquid to an application surface, said applicator comprising:

(a) a liquid container having a nozzle orifice from which a liquid is emitted;

(b) a nozzle member removably affixed to said nozzle orifice, said nozzle member having a nozzle into which the liquid emitted from said nozzle orifice is discharged;

(c) an applicator tool body; and (d) means for circumferentially mounting said applicator tool body on said nozzle member by at least one pair of non-helical intermeshing projecting members and channels so that said applicator tool body is freely rotatable through an unlimited number of rotations with respect to said nozzle member;

wherein said applicator tool body comprises a spatulate section projecting from one side surface of the body of the applicator tool body, said spatulate section having a discharge orifice formed in an inner circumferential side thereof through which liquid is dispensed from the applicator tool body radially inwardly, and a communication channel to provide liquid communication between said nozzle of the nozzle member and said discharge orifice, the rotation of said applicator tool body having substantially no effect on the flow rate of said liquid through said discharge orifice, wherein said applicator tool body further comprises a cylindrical guide pin projecting from a side surface of the body of the applicator tool body and spaced from the spatulate section for holding between the guide pin and the spatulate section said application surface, whereby the coaction of said guide pin and said spatulate section maintains the application of liquid dispensed through said discharge orifice upon said application surface.

2. The liquid applicator of claim 1, wherein said means for circumferentially mounting said applicator tool body on said nozzle member includes a projecting member formed on the circumferential surface of said nozzle member, and a circumferential channel formed in said applicator tool body to receive said projecting member of the nozzle member.

3. The applicator tool for liquids of claim 2, further comprising a cylindrical member of a suitable thickness with an internal diameter equivalent to the external diameter of the guide pin, said cylindrical member being fitted onto the guide pin, whereby the space between the spatulate section and the guide pin are adjusted.

4. The applicator tool for liquids of claim 3, wherein said spatulate section has a brush member on one side forming a discharge orifice.

5. The applicator tool for liquids of claim 2, wherein said spatulate section has an irregular section on one side forming a discharge orifice.

6. The applicator tool for liquids of claim 2, wherein said discharge orifice is formed along the longitudinal direction of the spatulate section from its base end to tip end.

7. The applicator tool for liquid of claim 2, wherein said applicator tool body can be removed from the nozzle member and the tip section of the nozzle member has a shape appropriate to carry out the application action at this section, whereby the application action can be implemented either with the applicator tool or nozzle tip section as required.

8. The applicator tool for liquids of claim 2, wherein the said spatulate section can expand and contract along its longitudinal direction, whereby the application position and application width can be adjusted.

9. The applicator tool for liquids of claim 2, wherein said nozzle orifice is threaded, and said nozzle member is removably affixed to the nozzle orifice by being screwed onto the threads of the nozzle member.

10. The applicator tool for liquids of claim 2, further comprising a cap member to be fitted to the tip of the applicator tool, said cap member having a protruding section for closing the discharge orifice when the cap member is fitted to the tip of the applicator tool.

* * * * *